US005167400A

United States Patent [19]

Gazel-Anthoine

[11] Patent Number: 5,167,400

[45] Date of Patent: Dec. 1, 1992

[54] HAS INVENTED CERTAIN AND USEFUL IMPROVEMENTS IN CONTROL DEVICE FOR LIFTING WINCHES, IN PARTICULAR FOR DRILLING RIGS

[75] Inventor: Gilles Gazel-Anthoine, Rueil-Malmaison, France

[73] Assignee: Plateformes et Structures Oceaniques, Cedex, France

[21] Appl. No.: 540,773

[22] Filed: Jun. 20, 1990

[30] Foreign Application Priority Data

Jun. 23, 1989 [FR] France ..... 89 08369

[51] Int. Cl.[5] ..... B66D 1/50; B66D 1/12; B66D 5/02

[52] U.S. Cl. ..... 254/275; 254/276; 254/342; 254/362; 254/375

[58] Field of Search ..... 254/267, 275, 276, 362, 254/378, 379, 342, 375

[56] References Cited

U.S. PATENT DOCUMENTS

| | | | |
|---|---|---|---|
| 1,892,130 | 12/1932 | Benson | 254/275 |
| 1,899,703 | 2/1933 | Lindner | 254/362 X |
| 2,238,622 | 4/1941 | Borland | 254/276 X |
| 2,275,953 | 3/1942 | Frisch | 254/276 X |
| 2,298,222 | 10/1942 | McShane | 254/275 |
| 2,474,267 | 6/1949 | Mahnke | 254/362 X |
| 2,558,517 | 6/1951 | Handelman | 254/276 X |
| 2,656,027 | 10/1953 | Crookston | 254/276 X |
| 3,101,828 | 8/1963 | Wilson | 254/276 X |
| 3,819,156 | 6/1974 | Sieracki | 254/361 X |
| 3,838,846 | 1/1974 | Ostrom | 254/275 |
| 3,918,713 | 11/1975 | Kaminstein | 254/275 X |
| 3,945,612 | 3/1976 | Motoda | 254/173 R |
| 4,022,432 | 5/1977 | Toyomura et al. | 254/379 X |
| 4,046,355 | 9/1977 | Martin | 254/273 |
| 4,177,973 | 12/1979 | Miller et al. | 254/276 |
| 4,187,546 | 2/1980 | Hefferman et al. | 364/565 |
| 4,434,971 | 3/1984 | Cordrey | 254/276 X |
| 4,461,015 | 7/1984 | Kulhavy | 377/24 |
| 4,545,017 | 10/1985 | Richardson | 254/276 X |
| 4,627,519 | 12/1986 | Larsen et al. | 254/379 X |
| 4,636,962 | 1/1987 | Broyden et al. | 254/276 X |
| 4,748,563 | 5/1988 | Anthoine | 364/420 |

FOREIGN PATENT DOCUMENTS

| | | | |
|---|---|---|---|
| 1136472 | 9/1962 | Fed. Rep. of Germany . | |
| 2502809 | 7/1976 | Fed. Rep. of Germany | 254/275 |
| 3424590 | 1/1986 | Fed. Rep. of Germany . | |
| 2559540 | 8/1985 | France . | |
| 1206259 | 9/1970 | United Kingdom . | |
| 2074970 | 11/1981 | United Kingdom . | |
| 2101952 | 1/1983 | United Kingdom . | |

OTHER PUBLICATIONS

Muller, "Elektrotechnische Systeme", Technische Rundschau, Apr. 16, 1974, vol. 66, No. 15, pp. 41–45.

G. Pasternak, "Transmissions diesel-électriques dans le forage pétrolier", Technip, 1970, pp. 14–15, 193 and 220.

*Primary Examiner*—Daniel P. Stodola
*Assistant Examiner*—Michael R. Mansen
*Attorney, Agent, or Firm*—Longacre & White

[57] ABSTRACT

A control device for lifting winches, in particular for drilling rigs, uses an electric motor able to operate in all four quadrants of the torque-speed diagram. A control circuit procures controlled excitation of the electric motor. A manipulator on a control panel controls the control circuit by establishing, according to its position, a given speed request instruction. An indexing circuit for controlling the control circuit is adapted, on the bases of predetermined end of travel positions and a given law relating the speed to the difference in height between a given end of travel position and the actual height at the time in question, to establish a given speed request instruction. A comparator passes to the control circuit only the speed request instruction that it receives representing the lower speed.

23 Claims, 3 Drawing Sheets

HAS INVENTED CERTAIN AND USEFUL IMPROVEMENTS IN CONTROL DEVICE FOR LIFTING WINCHES, IN PARTICULAR FOR DRILLING RIGS

BACKGROUND OF THE INVENTION

1. Field of the invention

The present invention is generally concerned with lifting winches.

It is more particularly concerned with drilling rigs.

2. Description of the prior art

The lifting winch on a drilling rig is conventionally driven by a unidirectional diesel engine or DC electric motor coupled to a clutch, a gearbox and a brake for stopping the string of drilling pipes during raising or lowering and for controlled retention during lowering or drilling.

A water cooling circuit is usually provided for the brake, which is usually a belt type friction brake, and a hydraulic or electromagnetic retarder is also usually provided.

Apart from the resulting area of the drilling rig deck taken up by the system and the inevitable additional noise due to the friction brake, the major disadvantage of this drive method is that in practice it requires continuous control over the parameters of the movement being carried out including distance, speed, acceleration and force.

In particular, the operator is responsible for keeping to the authorized maximum speeds during raising and lowering and for halting the string of drilling pipes at the end of upward or downward movement at positions that are specified to a greater or lesser degree, whilst also monitoring the various dials on the control panel.

Given these conditions, mishaps are by no means rare, especially at the ends of travel.

To minimize this risk it is usual practice to provide generous stopping distances as a safety measure, especially at the top. This increases the height of the derrick and the operator, working by sight, naturally tends to start the slowing process each time sooner than is strictly necessary, which is detrimental to productivity.

This problem is accentuated by the fact that when an electromagnetic retarder is used it is also necessary to allow for its non-negligible response time.

French Pat. No. 2 559 540 proposes to use sensors for automatically controlling the raising travel of the string of drilling pipes so that it can be systematically stopped in an accurate manner at the end of travel under optimum conditions.

However, the motor driving the lifting winch is a conventional unidirectional motor associated with a friction brake and an electromagnetic slowing device.

In "Transmissions diesel-électriques dans le forage pétrolier" ("Diesel-electric transmission systems for oil drilling applications") by G. PASTERNAK published by TECHNIP in 1970, it is proposed to substitute for the unidirectional motor an electric motor able to operate in all four quadrants of the torque-speed diagram.

This of course presupposes the provision of control means for controlled excitation of the electric motor with, as is standard practice in controlling electric motors, a manipulator disposed on an operator control panel and positioned to establish a given speed or displacement request instruction addressed to the control means.

As used here the term "excitation" is to be understood in a general sense as referring to all aspects of supplying electric power to an electric motor, without necessarily being limited, for example, to the energization of the rotor in the case of a synchronous motor or to the energization of the stator in the case of a DC motor.

There is no utility in providing a clutch, a conventional type gearbox, a friction brake or an electromagnetic retarder because the electric motor used is inherently able to regulate the speed and position of the string of drilling pipes directly, both during raising, when it actually functions as a motor, and during lowering, when it functions as a generator, with the possible exception of an initial acceleration phase.

A general object of the present invention is a control device for lifting winches, in particular for a drilling rig, with the advantage of enabling use of this arrangement.

SUMMARY OF THE INVENTION

The present invention consists in a control device for lifting winches, in particular for drilling rigs, using an electric motor able to operate in all four quadrants of the torque-speed diagram, control means for controlled excitation of said electric motor, an operator control panel, associated with said control panel a manipulator for controlling said control means by establishing, according to its position, a given speed request instruction, an indexing circuit for controlling said control means adapted, on the basis of predetermined end of travel positions and a given law relating the speed to the difference in height between a given end of travel position and the actual height at the time in question, to establish a given speed request instruction, and a comparator adapted to allow to pass to said control means only the speed request instruction that it receives representing the lower speed.

Space and weight are advantageously saved on the drilling rig deck by the elimination of the clutch, the conventional type gearbox, the friction brake and the retarder.

Additionally, all noise due to the friction brake is advantageously eliminated.

However, a parking and emergency brake is preferably provided, a disk brake, for example.

This parking and emergency brake is used only when the winch is stopped or in the event of an incident, however.

Unlike the prior art friction brake, it is not employed systematically during normal working to slow down the load.

It does not generate any noise during normal working and requires no water cooling circuit.

There is preferably provided between the motor and the lifting winch a speed reducer advantageously enabling the use of a faster running and therefore less costly motor; it establishes two separate speed reduction ratios and therefore two separate speeds.

The overall size, weight and cost of a speed reducer of this kind are in no way comparable with those of a conventional type gearbox, however.

Using the control device in accordance with the invention has the advantage that the end of travel positions are accurately complied with and the same applies to the authorized maximum speeds, piston induced suction being unequivocally prevented.

This improves safety and, to the benefit of productivity, the speed, acceleration and deceleration are systematically optimized.

Control of operation does not require the operator to exert large forces or to perform large amplitude movements.

In particular, no longer needing to monitor the position of the mobile pulley block from which the drilling pipes are suspended, the operator can advantageously devote his attention to other aspects of his work.

This makes the operator's work more agreeable and less fatiguing and improves safety and productivity.

The position control function of the control device in accordance with the invention can easily be implemented with digital technology and this favors complete automation of all the necessary maneuvers.

Moreover, if required the control device in accordance with the invention can easily be installed remotely from the lifting winch, with no mechanical connection to the latter.

Finally, according to a preferred and practical feature of the invention the end of travel positions to which the indexing circuit is slaved are programmable.

This has the advantage that they are therefore very easily modified to suit changing requirements, especially if a few meters of cable are let slip at regular intervals, in the usual way, to compensate for any fatigue effects and/or any wear of the cable from which the string of drilling pipes is suspended.

It is then sufficient to modify these end of travel positions to recalibrate the system to the new section of cable used for these maneuvers.

The characteristics and advantages of the invention will emerge from the following description given by way of example with reference to the appended diagramatic drawings.

DETAILED DESCRIPTION OF THE INVENTION

Figure 1:
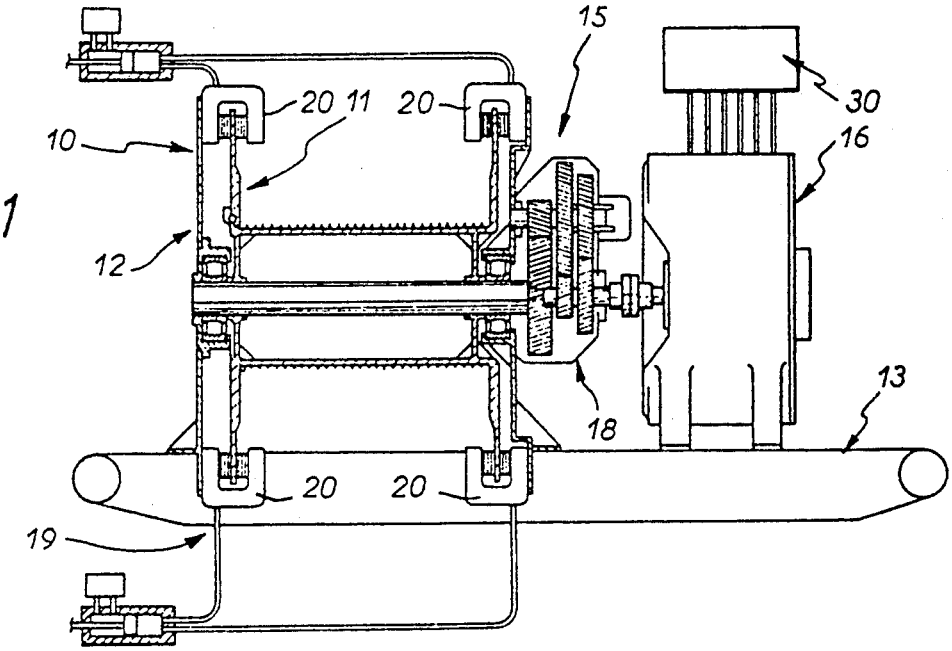
FIG. 1 is an elevation view in cross-section of the mechanical part of the control device in accordance with the invention.

Referring to FIG. 1, the invention is concerned with controlling a lifting winch 10 to the drum 11 of which is attached a cable (not shown).

In the embodiment shown the frame 12 of the lifting winch 10 is carried by a chassis 13 to facilitate handling it and installing it on the deck of the installation concerned.

In practice this is a drilling rig.

Figure 7:
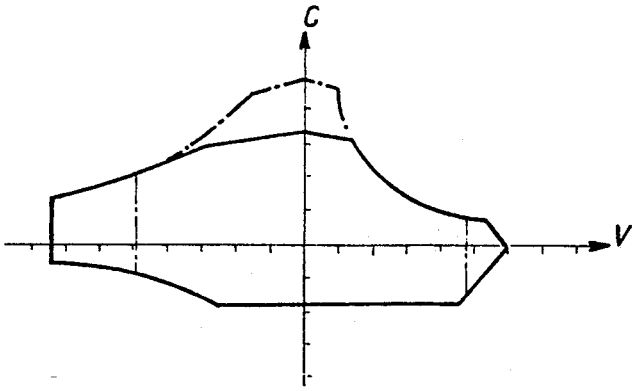
FIG. 7 is a diagram illustrating the mode of operation of the electric motor used in the control device in accordance with the invention.

In a known way the control device 15 which drives the drum 11 of the lifting winch 10 uses an electric motor 16 which, as schematically shown in FIG. 7, is able to operate in all four quadrants of the torque-speed diagram.

In the FIG. 7 diagram the rotation speed V is plotted on the horizontal axis, on the positive side for raising and on the negative side for lowering.

The torque C is plotted on the vertical axis, on the positive side for raising and on the negative side for lowering.

In the first quadrant, which represents the application of a drive torque for raising, the electric motor 16 functions as a motor.

In the second quadrant, which represents the application of a retaining torque during lowering, it functions as a generator.

In the third quadrant, which represents the application of an acceleration torque during lowering, as may be necessary at the start of travel if the weight of the load is not high enough, it functions as a motor.

In the fourth quadrant, which represents the application of a retaining torque during raising, it functions as a generator.

Of course, the torque-speed diagram may be different from that shown in FIG. 7.

A speed reducer 18 is preferably provided between the shaft of the electric motor 16 and that of the drum 11 of the lifting winch 10 to establish at least two different speed reduction ratios, one corresponding to a slow speed used, for example to lower a casing or instrumentation, the other corresponding to a fast speed.

In the FIG. 7 diagram the curve in full line corresponds to the slow speed and the curve in chain-dotted line corresponds to the fast speed.

However, there is no gearbox more complex than the simple speed reducer 18, no clutch and no electromagnetic or hydraulic retarder in the transmission between the electric motor 16 and the drum 11 of the lifting winch 10.

Nor is the drum 11 of the lifting winch 10 equipped with any kind of brake to be used in normal operation.

However, there is preferably associated with it a parking and emergency brake 19, in other words a brake intended to be used only when the winch is stopped or, exceptionally, in an emergency.

In the embodiment shown the parking and emergency brake 19 comprises four disk brake units 20 operating in pairs on the flanges of the drum 11.

Although it could equally well be an asynchronous motor or even a DC motor, the electric motor 16 is preferably a synchronous motor.

Figure 5:
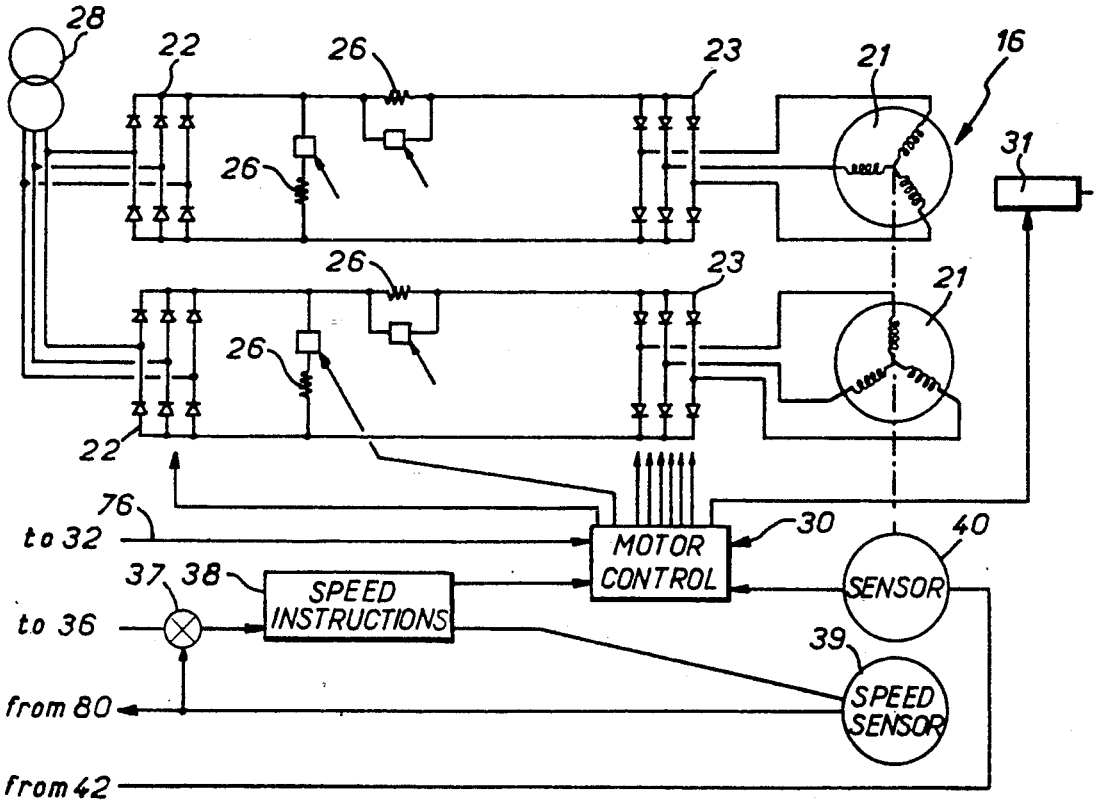
FIG. 5 is a circuit schematic relating to the electric motor included in the control device in accordance with the invention and the associated control means, with part of the circuit feeding the control means.

In the embodiment shown, and as schematically represented in FIG. 5, it is a synchronous motor whose stator comprises two star windings 21 offset at 30° which by increasing the number of commutator switching cycles per revolution with the same number of poles advantageously reduces jerking and the positioning increment.

In the embodiment shown a rectifier 22 and an inverter 23 are associated with each star winding 21.

As an alternative to this, however, a single rectifier could be provided or commutator means could be provided suitable for a series or parallel arrangement of the inverters 23.

The corresponding provisions will be evident to those skilled in the art.

Finally, dissipator resistors 26 are preferably provided for each star winding 21.

In the embodiment shown the dissipator resistors 26 are located between the rectifier 22 and the inverter 23.

As an alternative, however, they could equally well be on the input side of the rectifier 22.

As a further alternative, resulting from the use of the invention, they could equally well be on the output side of the inverter 23, in other words between the inverter 23 and the corresponding star winding 21, i.e. connected directly across the star winding 21.

This improves the security of the electric braking provided by the dissipator resistors 26.

The number of components between them and the electric motor 16 whose failure could lead to loss of electrical braking is therefore advantageously reduced, but the excitation of the motor 16 must be safeguarded in some other way, of course.

Power is supplied to the electric motor 16 from an AC power supply 28 (FIG. 5). Associated with the electric motor 16 are control means (FIGS. 1 and 5) for controlled excitation of the motor.

As schematically shown at 31, the control means 30 are adapted to supply current to the rotor of the electric motor 16.

In practice they are also adapted to switch the inverters 23 at the appropriate time and possibly to switch the dissipator resistors 26.

The nature of the control means 30 will be evident to those skilled in the art and will not be described in more detail here.

The nature of the control means 30 are operated by a manipulator 32 (FIGS. 3 and 6) adapted to establish a given speed request instruction according to its position and in a manner that will be described in more detail later.

Figure 2:
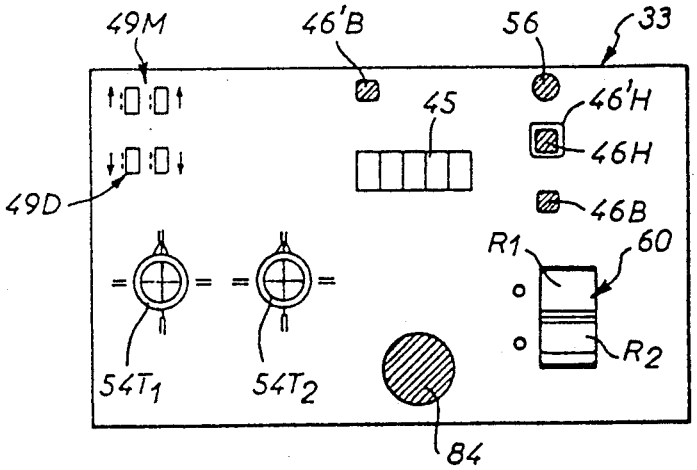
FIG. 2 is an elevation view of the control panel for the operator in charge of the control device.

In practice the manipulator 32 is associated with an operator control panel 33 (FIG. 2).

In accordance with the invention the control device 15 further comprises, for controlling the control means 30, a circuit 35 (FIG. 6) referred to hereinafter for convenience only as an indexing circuit which on the basis of defined end of travel positions and a given law L relating the speed V' to the difference in height Z between a given end of travel position and the actual height at the moment in question is also able to establish a given speed request instruction, as schematically represented by the inclusion of the diagram representing this indexing circuit 35 in FIG. 6; a comparator 36 is adapted to pass to the control means 30, via a comparator 37 and a speed instruction generator circuit 38, only the speed request instruction it receives corresponding to the lower speed.

In this context by the speed V' is meant the speed required at a given time, the actual speed at this time being denoted V.

In addition to the speed request instruction passed on by the comparator 36, the comparator 37 receives, in a loop controlling the speed of the electric motor 16, a speed signal delivered by a speed sensor 39 which is responsive to rotation of the transmission between the electric motor 16 and the drum 11 of the lifting winch 10; as schematically represented by dashed lines in FIG. 5, it is for example keyed to the shaft of the electric motor 16. It also feeds its speed signal to the speed instruction generator circuit 38.

Connected to the speed sensor 39 is a position sensor 40 in the form of a pulse generator delivering pulses at a frequency related to the sensed speed.

In the embodiment shown the position sensor 40 is also keyed to the shaft of the electric motor 16.

As an alternative to this, it may equally well be keyed to the drum 11 of the lifting winch 10, however.

The output from the position sensor 40 is used in particular by the control means (FIG. 5).

It also feeds pulses to a counter 42 (FIG. 6) which accumulates these pulses.

The end of travel positions to which the indexing circuit 35 is slaved are preferably programmable from the control panel 33.

To this end in the embodiment shown a marker pushbutton 46B on the control panel 33 is adapted to reset the counter 42 to program a first end of travel position, for example the bottom end of travel position.

The control panel 33 further comprises a second marker pushbutton 46H which, to program the second end of travel position, the top end of travel position, for example, is adapted to enable this second end of travel position to be set relative to the first.

At least one of the two marker pushbuttons 46B, 46H (in practice the marker pushbutton 46H corresponding to the top end of travel position) operates on a memory 48H (FIG. 6) which is fed by the counter 42 and which feeds a comparator 44 in conjunction with the counter 42, through a switch 47C, another input of which is connected to a zero memory 48B.

The comparator 44 yields the height difference Z and feeds the indexing circuit 35.

Depending on what it receives from the comparator 44 and in accordance with the speed law L to be respected, the indexing circuit 35 generates the speed instruction to stop at one or other of the corresponding end of travel positions, with the required deceleration.

Figure 6:
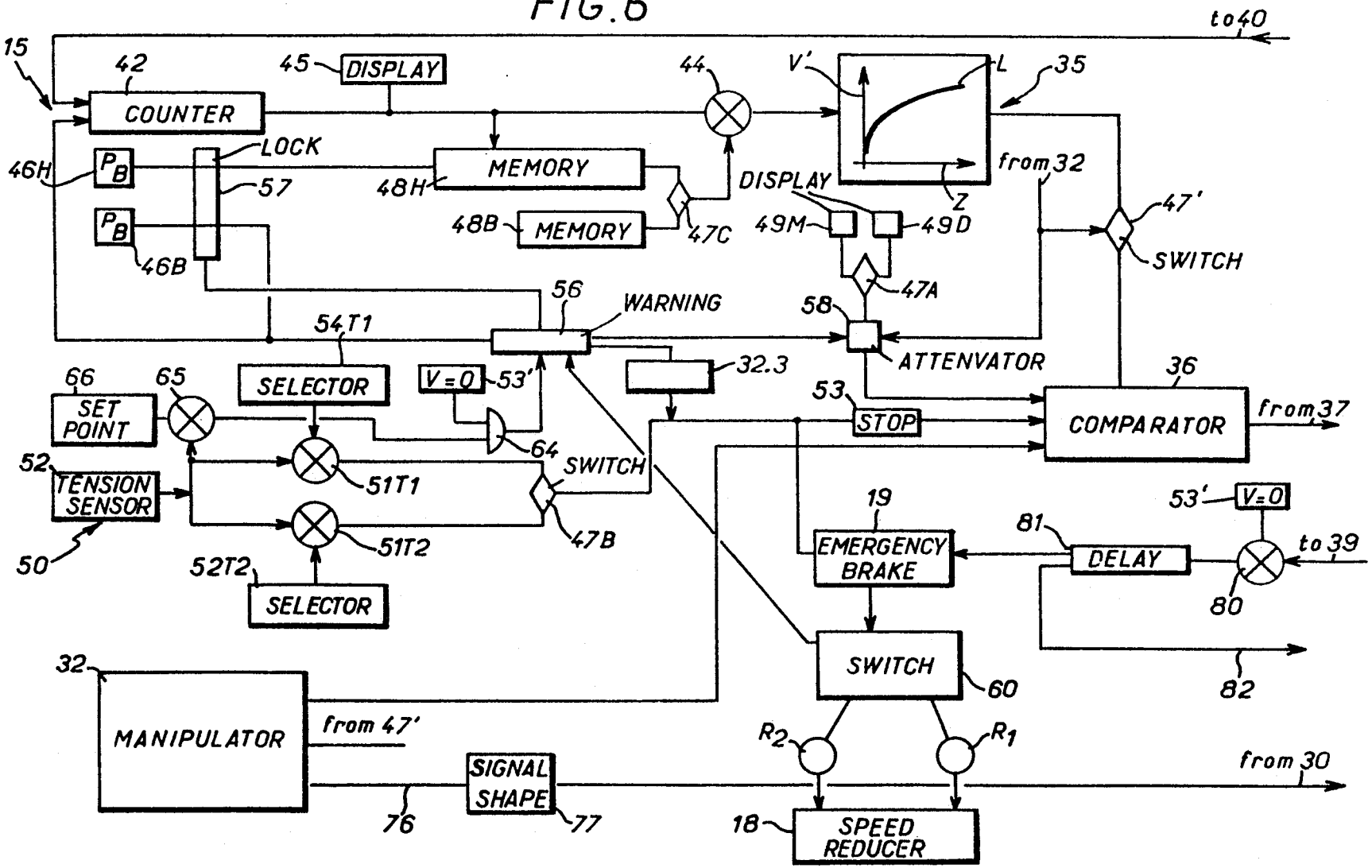
FIG. 6 is a circuit schematic relating to another part of this circuit.

As schematically represented in FIG. 6 the counter 42 preferably also feeds a display unit 45 on the control panel 33 constituting a displacement indicator.

As schematically shown in FIG. 2, it may be adapted to display at all times the number of pulses accumulated by the counter 42.

However, it could equally well be an indicator lamp arranged to blink on and off if this number varies, the essential requirement being to indicate at the control panel 33 the moving or stopped configuration of the string of drilling pipes.

In addition to the speed instruction that it receives from the indexing circuit 35, the comparator 36 receives two fixed speed instructions respectively corresponding to the maximum authorized raising speed and the maximum authorized lowering speed.

The control panel 33 includes two display units 49M, 49D for indicating the corresponding maximum authorized speeds.

The display units 49M, 49D are shown in FIG. 6 to represent the transmission of the corresponding speed request instructions to the comparator 36 via a switch 47A.

As schematically shown in FIG. 6 the comparator 36 is also slaved to a safety circuit 50 connected to a tension sensor 52 responsive to the tension in the cable attached to the drum 11 of the lifting winch 10 and adapted to send to it (as schematically represented at 53) an instruction to stop (V=0) if this tension is outside a range defined by two predetermined tension values, a minimum value and a maximum value.

The control panel 33 includes two selectors 54Tl, 54T2 for programming the corresponding minimum and maximum cable tension values.

The selectors 54Tl, 54T2 are also shown in FIG. 6.

They feed respective comparators 55T1, 55T2 which are also fed by the tension sensor 52 and which conjointly feed the comparator 36 through a switch 47B.

Four cable tension values, for example, may be chosen for each of the selectors 54T1, 54T2.

The security circuit 50 also includes a warning device 56 represented by an indicator lamp on the control panel 33. When it is not energized it disables the marker pushbuttons 46B, 46H to prevent any use thereof, as schematically represented at 57 in FIG. 6.

When it is excited, the warning device 56 switches in an attenuator 58 adapted to reduce by a specified amount, for example by half, the maximum authorized speeds indicated on the control panel 33 by the display units 49M, 49D.

Excitation of the warning device 56 is conditioned by a switch 60 enabling selection from the control panel 33 of one or other of the two speed reduction ratios R1, R2 of the speed reducer 18 when, as shown here, the position sensor 40 is keyed to the shaft of the electric motor 16.

As schematically represented in FIG. 6, the switch 60 is in turn conditioned by the brake 19 so that the ratio of the speed reducer 18 can only be changed when the winch is stopped, with no load, with the brake 19 applied and with the electric power supply interrupted.

As an alternative to this, however, if the position sensor 40 is keyed to the drum 11 of the lifting winch 10, it is not necessary for changing of the speed reducer 18 ratio to lead to excitation of the warning device 56.

Excitation of the warning device 56 is also conditioned by an AND type logic circuit 64 receiving, as schematically represented at 53', a signal V=0 when the speed V is null and the signal delivered by a comparator 65 driven by the tension sensor 52 and a unit 66 supplying a set point value for the corresponding cable tension.

The warning device 56 is excited if the cable tension is below the set point value and the speed V is null.

The warning device 56 is reset by the marker pushbutton 46B.

As a safety measure, if the warning device 56 is not already excited, operation of the marker pushbutton 46B requires previous operation of a pushbutton 46'B to alleviate the consequences of fortuitous or involuntary operation of the marker pushbutton 46B.

Likewise as a safety measure the marker pushbutton 46H is protected by a flap 46'H.

Figure 3:
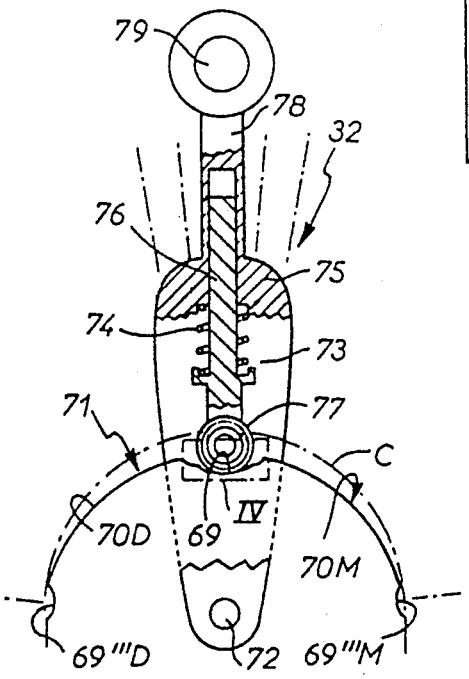
FIG. 3 is an elevation view in cross-section of a manipulator used by the operator.
Figure 4:
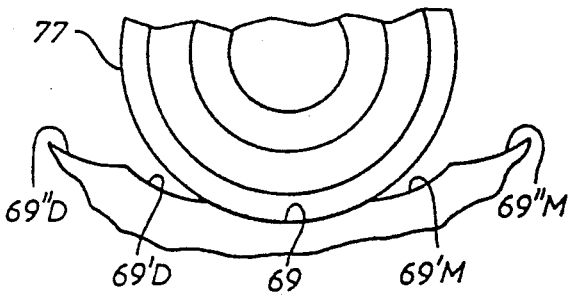
FIG. 4 shows to a larger scale the detail from FIG. 3 indicated by the rectangle IV in FIG. 3.

In the embodiment shown, the manipulator 32 is in the form of a lever pivoting to either side of a neutral rest position shown in FIG. 3.

Moving it to one side represents a displacement or speed request in a first direction, raising, for example, and moving it to the other side represents a displacement or speed request in the opposite direction, lowering in this case.

The lever is associated with a notch 69 to define its neutral rest position and, on its opposite sides, as will be explained in more detail later, notches 69M, 69D defining specific positions for the lever, without any return torque exerted on it, corresponding to raising for the notches 69M and lowering for the notches 69D; between the notches 69M, 69D is a cam 70M, 70D which returns the lever systematically to its neutral rest position.

The notches 69M, 69D and the cams 70M, 70D are in practize parts of the edge of a common disk 71 whose profile from the ends of a diameter perpendicular to the neutral rest position of the manipulator 32 to its summit region progressively and symmetrically diverges from that of a circle C schematically represented in chain-dotted line in FIG. 3.

As shown, the manipulator 32 may be in the form of a yoke, for example, pivoting on a pin 72 about the center of the disk 71, its two flanges 73 embracing the latter.

Sliding radially between the two flanges 73 against a spring 74 bearing against the corresponding median part 75 is a pin 76 carrying at its free end a cam follower roller 77 adapted to cooperate with the edge of the disk 71 and therefore with the notches 69M, 69D and the cams 70M, 70D of the latter.

In practice three notches 69M, 69D are provided to either side of the neutral rest position of the manipulator 32.

Firstly, immediately adjacent the notch 69, there is a first notch 69'M, 69'D at which the manipulator 32 establishes a displacement request instruction in the form of a pulse.

Then, immediately adjacent this first notch 69,M, 69'D, there is a second notch 69''M, 69''D at which the manipulator 32 establishes a displacement request instruction in the form of a stream of pulses.

Finally, at a distance from the second notch 69''M, 69''D and in practice in the immediate vicinity of the ends of the diameter perpendicular to the neutral rest position of the manipulator 32, there is a third notch 69'''M, 69'''D at which, as at the previously described notches, the manipulator 32 is in a stable position, without being subjected to any return torque, and at which the manipulator 32 establishes a continuous speed request instruction corresponding to a maximum speed.

The cam 70M, 70D extends continuously from the second notch 69''M, 69''D to the third notch 69'''M, 69'''D and, along the entire length of the cam 70M, 70D, the manipulator 32 establishes a continuous speed request instruction corresponding to a value related to its position, for example by means of a rotary potentiometer keyed to it (not shown).

Given the profile of the cam 70M, 70D, the return torque exerted on the manipulator 32 when it is engaged with the cam 70M, 70D increases with its angular position along the latter.

As will readily be understood, the first notch 69'M, 69'D advantageously enables incremental modification, by increments of a few millimeters, for example, of the position of the string of drilling pipes, or more generally, of the corresponding mobile pulley block, by raising or lowering the latter.

The second notch 69''M, 69''D allows modification of this position in bursts of increments.

In an analogous way, the cam 70M, 70D corresponds to a speed command with a value related (for example proportional) to the displacement of the manipulator 32.

The third notch 69'''M, 69'''D enables the operator to release the manipulator 32, which then remains at the maximum speed position.

By means of a cam and a switch contact (not shown) the manipulator 32 activates the switches 47 as appropriate to the current situation (stopped, raising or lowering) so that only the corresponding lines are in service, the authorized maximum speeds not necessarily being the same on raising and lowering, for example.

As a safety measure, and as schematically represented at 32.3 in FIG. 6, if the warning device 56 is excited, a stop instruction (V=0) is systematically requested (at 53) if the manipulator 32 is in the position corresponding to the third notch 69'''M, 69'''D.

As schematically shown in FIGS. 5 and 6 the incremental displacement command instructions from the manipulator 32 in the positions corresponding to the notches 69'M, 69'D, 69''M, 69''D are directly transmitted by a line 76 optionally comprising a signal shaping circuit 77 to the control means 30; the analogous continuous command instructions in the positions corresponding to the cam 70M, 70D or to the notches 69'''M, 69'''D are transmitted to the comparator 36.

In the embodiment shown and as schematically represented in FIG. 3 the manipulator 32 carries at the free end of its handle 78 a pushbutton 79 enabling the operator to override, if required, the end of travel positions to which the indexing circuit 35 is slaved.

In this case the speed request instruction from the indexing circuit to the comparator 36 is blocked by a switch 47' and the attenuator 58 is activated as a safety measure.

A comparator 80 receives, as schematically represented at 53', a signal V=0 delivered by the speed sensor 39. A variable time-delay (two seconds, for example) device 81, activates the brake 19, simultaneously cutting off the supply of electric power to the electric motor 16, and a line 82 for putting into memory the motor electrical parameters.

The operator also has a control 84 on the control panel 33 for operating the brake 19 if necessary.

On starting work the operator lowers the travelling or mobile pulley block from which the string of drilling pipes is suspended (or is to be suspended) to the position which the operator requires to be its bottom end of travel position.

After pressing the pushbutton 46'B, which in practize activates the warning device 56, the operator then presses the marker pushbutton 46B which resets the counter 42; the selected bottom end of travel position is therefore taken as the origin.

The operator proceeds in the same way for the top end of travel position to be imposed by pressing the marker pushbutton 46H after moving the mobile pulley block to the corresponding top point.

This top end of travel position is then entered into the memory 48H.

In theory the operator need only modify the top end of travel position systematically when called upon to alter the bottom end of travel position.

This completes the required recalibration.

The operator carries out a similar recalibration each time the cable is let slip.

This recalibration is also required if the warning device 56 is excited, as materially represented by the blinking on and off of the corresponding indicator lamp.

As previously explained, the warning device 56 is excited, among other things, by changing the ratio of the speed reducer 18, unless the position sensor 40 is keyed to the drum 11 of the lifting winch 10.

This excitation also occurs if the cable has been let slip, which is detected by the AND logic circuit 64 when it receives simultaneously a null speed signal V=0 and a cable tension signal below a given set point value.

In either case the warning device imposes resetting of the bottom end of travel position.

As explained above, and to avoid any possibility of misoperation, if the manipulator 32 is in its maximum speed position 32.3 the warning device 56 is excited and a null speed request instruction (V=0) is sent to the comparator 36.

Similarly, if the warning device 56 is excited, the maximum speeds are reduced by the attenuator 58 (as compared with those sent), which prevents high speed displacement.

The marker pushbuttons 46H, 46B are locked, that is disabled, if the warning device 56 is excited, to avoid any possibility of a misoperation resulting in involuntary modification of the bottom end of travel position.

The pushbutton 46'B which is used to activate the warning device 56 is also used to release, in other words to enable, the marker pushbuttons 46H, 46B when they need to be used.

At all times the comparator 36 transmits to the control means 30 only the smaller of the speed request instructions that it receives.

After starting up, the operator therefore has only to place the manipulator 32 in the third notch 69'''M, 69'''D corresponding to a maximum speed request instruction.

The indexing device 35 then systematically causes the string of drilling pipes to be stopped at the corresponding top or bottom end of travel position.

If a stop at null speed for a predetermined time (two seconds, for example, although this time is advantageously variable) is sensed by the comparator 80, the brake 19 is operated and this causes a stop instruction (V=0) to be sent to the comparator 36 (at 53).

At the same time, the supply of electrical power to the stator of the electric motor 16 is interrupted to cancel its torque.

The relevant electrical parameters are placed in memory, however (82).

It is then possible to change the speed reduction ratio of the speed reducer 18, if required.

If a change of ratio is requested when the speed is non-null, it is not effected until the winch is stopped.

As previously explained, changing the speed reduction ratio of the speed reducer 18 causes the warning device 56 to be excited if the position sensor 40 is keyed to the shaft of the electric motor 16, which then imposes recalibration of the end of travel positions.

To re-apply the power the operator then need only move the manipulator 32 and the brake 19 is released.

Such re-application of power is impossible, however, if a change in the speed reduction ratio of the speed reducer 18 has been requested.

The construction of the various elements and units not described in detail hereinabove and of the circuits feeding them will be evident to those skilled in the art who need only know the function to propose an implementation thereof.

Nor is the present invention limited to the embodiment described and shown, but encompasses any variant execution thereof.

In particular, it is not obligatory for the speed reducer, if any, to have more than one speed reduction ratio.

Furthermore, to procure controlled positioning of the mobile pulley block, a computer may be provided to supply directly to the comparator 44 the required height, the speed request instructions emanating from the indexing circuit 35 being then addressed directly to the speed instruction generator circuit 38.

This computer then controls the various safety functions needed.

Likewise, the law relating the speed V' to Z may be modifiable if required.

Furthermore, it goes without saying that, although in the preceding description the cable tension is sensed by a tension sensor, corresponding at least generally to the suspended weight, the cable tension may be obtained by any other means.

Thus the term "tension sensor" must be understood in a broad sense in this context.

What is more, the control device in accordance with the invention may be applied to any lifting winch, whatever type of motor drives it, and even if the means developing the retaining torque are different than those providing the drive torque.

I claim:

1. Control apparatus for lifting winches for drilling rigs for raising and lowering a travelling block and a string of drilling pipes, comprising an electric motor operable in all four quadrants of a torque-speed diagram, control means for controlling excitation of said electric motor, an operator control panel, speed selector means associated with said operator control panel and operably connected to said control means for selecting and generating a first speed request instruction, an indexing circuit for controlling the motor control means, the travelling block having predetermined end-of-travel positions, said indexing circuit being responsive to a relationship of the speed of the electric motor as a function of the distance between one of the end-of-travel positions and an instantaneous travel position of the travelling block to calculate a second speed request instruction, a comparator for comparing the first and second speed request instructions and delivering the lower of the speed request instructions to said control means.

2. An apparatus according to claim 1 comprising means for programming the end-of-travel positions.

3. An apparatus according to claim 2 wherein said means for programming the end-of-travel positions are provided on said control panel.

4. An apparatus according to claim 3 comprising a counter for receiving pulses from sensor means responsive to rotation of a transmission disposed operatively between said electric motor and said lifting winch and counting said pulses and a marker pushbutton on said control panel for resetting said counter to program a first of said end-of-travel positions.

5. An apparatus according to claim 4 wherein said counter actuates a displacement indicator device provided on said control panel.

6. An apparatus according to claim 4, wherein said control panel includes a second marker pushbutton for programming a second end-of-travel position relative to said first end-of-travel position.

7. An apparatus according to claim 1 further comprising said means for storing third and fourth predetermined speed request instructions, one of the third and fourth speed request instructions corresponding to a maximum authorized raising speed and the other of third and fourth speed request instructions to a maximum authorized lowering speed, said means for storing third and fourth speed request instructions inputting said comparator.

8. An apparatus according to claim 7 wherein said control panel includes who display units for indicating the maximum authorized speeds.

9. An apparatus according to claim 1 wherein said comparator is also slaved to a safety circuit conditioned by sensor means responsive to tension in a cable attached to the winch and operable for sending a stop instruction to said comparator when the tension in the cable is outside a range defined by respective minimum and maximum tension values.

10. An apparatus according to claim 9 wherein said control panel includes two selectors for programming respective minimum and maximum cable tension values.

11. An apparatus according to claim 9 wherein, for sending a stop instruction to said comparator, said safety circuit comprises warning means, an AND type logic circuit conditioning the warning means and receiving a signal when the speed is null and a signal from another comparator responsive to said tension sensor means and by a unit supplying a set point value for the corresponding cable tension.

12. An apparatus according to claim 11 wherein means mandatorily updating at least one of said end-of-travel positions when said warning means has been excited.

13. An apparatus according to claim 11 wherein said warning means is adapted, when excited, to send a stop instruction to the first mentioned comparator if said speed selector means is simultaneously in a position corresponding to a maximum speed request instruction.

14. An apparatus according to claim 11 wherein said warning means, when excited, activates an attenuator for reducing the maximum authorized speeds is given proportions.

15. An apparatus according to claim 1 wherein said speed selector means comprising a manipulator pivotable to either side of a neutral rest position, notches on each side of said rest position for defining specific positions of said manifuplator and, between such notches, a cam configured to return the manipulator systematically towards its neutral position.

16. An apparatus according to claim 15 wherein said notches comprise a first notch corresponding to a displacement request instruction in the form of a single pulse, a second notch corresponding to establish a displacement request instruction in the form of a stream of pulses, and a third notch corresponding to a continuous speed request instruction at maximum speed, a corresponding cam portion between second notch to said third notch, and all positions of said manipulator along the length of said cam portion corresponding to discrete continuous speed request instructions related to the position of the manipulator.

17. An apparatus according to claim 1 wherein said speed selector means comprises a lever.

18. An apparatus according to claim 1 wherein said speed selector means comprises a manipulator carrying a pushbutton for overriding the end-of-travel positions.

19. An apparatus according to claim 1 wherein said electric motor is synchronous motor.

20. An apparatus according to claim 1 further comprising speed reducing means between said electric motor and said lifting winch.

21. An apparatus according to claim 20 wherein said speed reducing means is adaptable to establish at least two different speed reduction ratios.

22. An apparatus according to claim 20 wherein said speed reducing means is adjustable to establish at least two different speed reduction ratios and said safety circuit includes a warning device conditioned by a switch enabling a speed reduction ratio of said speed reducing means to be selected from said control panel.

23. An apparatus according to claim 1 including a parking and emergency brake associated with said lifting winch.

* * * * *